US006922955B2

(12) United States Patent
Sanders

(10) Patent No.: US 6,922,955 B2
(45) Date of Patent: Aug. 2, 2005

(54) PRE-CAST DOCK LEVELER PIT

(76) Inventor: Mark Sanders, 3863 Willow Rd., Zionsville, IN (US) 46077

( * ) Notice: Subject to any disclaimer, the term of this patent is extended or adjusted under 35 U.S.C. 154(b) by 0 days.

(21) Appl. No.: 10/302,078

(22) Filed: Nov. 22, 2002

(65) Prior Publication Data

US 2004/0098931 A1 May 27, 2004

(51) Int. Cl.[7] ..... E04H 14/00

(52) U.S. Cl. ..... 52/173.1; 52/169.7; 52/173.2; 52/588.1; 52/581; 52/656.1; 52/656.9; 52/21; 52/189; 52/190; 404/71; 14/71.1; 14/71.3; 14/71.5

(58) Field of Search ..... 52/169.7, 169.8, 52/173.2, 250, 251, 294, 414, 588.1, 581, 656.1, 656.9, 21, 173.1, 189, 190; 404/71; 14/71.1, 71.3, 71.5

(56) References Cited

U.S. PATENT DOCUMENTS 1,768,061 A * 6/1930 Henderson ..... 52/190
3,063,122 A * 11/1962 Katz ..... 249/50
3,327,335 A * 6/1967 Beckwith et al. ..... 14/71.3
3,335,442 A * 8/1967 Kumpolt ..... 14/71.3
3,693,927 A * 9/1972 Jennings ..... 249/11
3,756,657 A * 9/1973 Johnson ..... 297/440.1
3,830,337 A * 8/1974 Todd ..... 182/46
3,922,946 A * 12/1975 Grayson ..... 411/385
4,093,173 A * 6/1978 Kawamata et al. ..... 249/105
4,118,817 A * 10/1978 Burnham ..... 14/71.3
4,516,368 A * 5/1985 Pichler ..... 52/190
4,539,780 A * 9/1985 Rice ..... 52/169.6
4,570,277 A * 2/1986 Hahn et al. ..... 14/71.3
4,679,762 A * 7/1987 Lee ..... 249/26
4,685,837 A * 8/1987 Cicanese ..... 405/282
4,882,882 A * 11/1989 Werner ..... 52/21
4,953,280 A * 9/1990 Kitzmiller ..... 29/412
5,003,750 A * 4/1991 Delgado ..... 52/741.11
5,396,676 A * 3/1995 Alexander et al. ..... 14/71.1
5,442,825 A * 8/1995 Hahn et al. ..... 14/71.1
5,624,147 A * 4/1997 Arteon et al. ..... 294/89
5,728,312 A * 3/1998 Van Doren ..... 249/165
5,755,982 A * 5/1998 Strickland et al. ..... 249/74
5,997,792 A * 12/1999 Gordon ..... 264/219
6,067,759 A * 5/2000 House ..... 52/198
6,106,191 A * 8/2000 Achenbach ..... 404/71
6,314,693 B1 * 11/2001 Sanders ..... 52/294
6,374,556 B2 * 4/2002 Crant et al. ..... 52/182
6,477,816 B1 * 11/2002 Di Biase ..... 52/588.1

* cited by examiner

*Primary Examiner*—Carl D. Friedman
*Assistant Examiner*—Christy M. Green
(74) *Attorney, Agent, or Firm*—Maginot, Moore & Beck

(57) ABSTRACT

A dock pit for a dock leveler mechanism comprises a pre-cast concrete body including integrally formed side, rear panel and front panels, all forming a continuous perimeter open therethrough to receive the load leveler mechanism. Each side panel has a top edge and the rear panel has a rear edge offset below the of the side panel top edges, whereby a concrete slab poured around the body will abut the rear panel edge with the surface of the concrete slab substantially flush with the top edge of each side panel. The side panels define a recess along their length that is situated between the top edge of the side panel and the rear edge of the rear panel, whereby the concrete slab poured around the pre-cast body will integrate within the recesses on each said side panel. The dock slab can be poured using the pre-cast pit as a form.

18 Claims, 5 Drawing Sheets

PRE-CAST DOCK LEVELER PIT

BACKGROUND OF THE INVENTION

The present invention relates to construction of loading docks and particularly loading docks having a dock leveler mechanism.

A loading dock provides a surface for loading and unloading cargo to and from the bed of a hauling vehicle. In a typical loading dock, a dock ramp inclines downward to meet the loading dock entrance. The dock ramp is at an elevation below the entrance to the loading dock so that the truck bed will be as close to the elevation of the loading dock floor as possible. However, the cargo beds of the hauling vehicles are not uniform, so there is often a step up or down form the loading dock to the vehicle cargo bed.

Dock levelers are commonly used in a loading dock environment to provide a bridge between the dock and the bed of the truck. Most typically, dock levelers are mounted within a pit at a level lower than the floor of the warehouse dock. The dock levelers include a deck that is hydraulically, mechanically or electrically extended so that the front lip of the deck is aligned with the bed of the truck. The rear of the deck is aligned with the dock floor to provide a smooth path for unloading product from the truck. The dock leveler can be retracted within the pit, with the deck generally co-extensive with the dock floor.

A typical dock leveler is described and shown in U.S. Pat. No. 4,928,340, issued on May 29, 1990, the disclosure of which is incorporated herein by reference. The dock leveler includes a frame structure that supports a lifting element, such as a hydraulic cylinder. The deck is pivotably supported on the frame structure at the inboard end of the leveler pit. The front lip can be hingedly mounted to the front end of the movable deck to provide a smooth transition from the truck bed to the deck. The deck is pivoted so that the leading edge of the deck is aligned at the height of the bed of a truck positioned at the end of the dock ramp.

As indicated above, most typically dock levelers are mounted within a pit below the level of the loading dock floor, but above the level of the dock ramp. The pit, like the building floor, and often the building walls, is formed of concrete. In the construction of a building having a loading dock, the practice has been to construct the building walls and form and pour the building floor. The loading dock pit is excavated before the floor is poured and forms are used to keep the pit clear. The excavated pit can then be formed and the pit walls poured. Once the poured leveler pit walls have cured, the dock leveler mechanism can be mounted within the pt.

This common approach to forming a dock leveler pit is very time consuming and labor intensive. Each pit requires about 4–5 days from trenching until the concrete has set sufficiently to install the leveler mechanism. Since each pit must be individually formed and poured, a multi-bay warehouse can take many days to complete. In addition the time delays inherent in this common process, the material and labor costs can be extreme. Moreover, since the dock leveler pit is poured separate from the building slab, forming errors can occur.

Pre-cast concrete structures are becoming more prevalent in industrial building. For instance, many warehouse building are formed of pre-cast wall panels. What is needed is a pre-cast dock leveler pit that eliminates the cost, labor and time delay associated with the traditionally poured pit.

SUMMARY OF THE INVENTION

In order to address this need, the present invention provides a dock pit for a dock leveler mechanism comprising a pre-cast concrete body including integrally formed side panels, a rear panel and a front panel, the panels forming a closed perimeter open therethrough. The perimeter is sized to receive the load leveler mechanism therein. The side panels each have a top edge and the rear panel has a rear edge offset below the top edge of the side panels, whereby a concrete slab poured around the pre-cast body will abut the rear edge of the rear panel with the surface of the concrete slab substantially flush with the top edge of each side panel.

Each of the side panels can define a recess along the length of the side panel between the front panel and the rear panel. The recess is situated between the top edge of the side panel and the rear edge of the rear panel, whereby when the concrete slab is poured around the pre-cast body the concrete will integrate within the recesses on each the side panel to fix the pre-cast pit. In addition, the rear panel can include a number of bent rebars extending from the rear edge and arranged to be embedded within the concrete slab when the slab is abutting the rear edge.

In a further feature of the invention, the dock pit further comprises a poured concrete slab within the perimeter defined by the panels. Thus, the perimeter of the pre-cast pit serves as a form for pouring the slab for supporting the dock leveling mechanism. The dock slab can be poured independent of the building slab.

The pre-cast dock pit is provided with lifting rings embedded within the pre-cast concrete body to facilitate transport and placement of the pre-cast pit at the building site. Preferably, the lifting rings include at least two lifting rings at a front portion of the pre-cast body and at least two lifting rings at a rear portion of the body. In this way, the pre-cast body can remain level and balanced as it is lifted and lowered to the dock site.

The front panel of the pre-cast pit is provided with a front footing edge, while the side panels include side edges. Preferably, the front panel is configured to overhang the side panels with the front footing edge offset below the side edges. This allows the side edges of the side panels to reside below the level of the ground within the building, or more particularly below the level of the building slab when it is poured. In addition, this configuration allows the front panel to be supported on the building wall ledge at the dock opening.

In one embodiment, the front panel includes a pair of opposite wings and a ledge disposed between and separating the wings. The ledge has a height less than the height of the wings so that the wings and the ledge define a front opening for providing access to a dock leveler mechanism mounted within the dock pit.

The present invention further contemplates a method for constructing a dock pit for supporting a dock leveler mechanism in a building construction, in which the building includes a building wall defining a dock opening and a ledge wall at the base of the dock opening, and further in which the ground inside the building has been prepared for laying a concrete slab therein. The method comprising the steps of:

a. excavating the ground inside the building immediately adjacent the dock opening;

b. providing a number of footings at the innermost portion of the excavation;

c. providing a pre-cast dock pit including integrally formed side panels, a rear panel and a front panel, the panels forming a closed perimeter open therethrough, the perimeter sized to receive the load leveler mechanism therein;

d. lifting and lowering the pre-cast dock pit into the excavation with the rear panel resting on the number of footing and the front panel resting on the ledge wall of the building wall;

e. forming a slab within the excavation to close the base of the perimeter of the pre-cast dock pit, thereby forming a slab for supporting the dock leveling mechanism; and f. forming the building slab around the pre-cast dock pit.

The method can further comprise the step of anchoring the front panel of the pre-cast dock pit to the building walls adjacent the dock opening when the pre-cast pit is introduced into the dock site. Preferably, the front panel of the pre-cast dock pit has a width substantially equal to the width of the ledge wall so that the front panel abuts the building walls adjacent the dock opening. When the pre-cast pit is finally positioned within the dock opening, the joint between the front panel of the pre-cast dock pit and the ledge wall and adjacent building walls can be sealed, such as by caulking.

In a preferred form of the pre-cast pit, each of the side panels defines a recess along the length of the side panel between the front panel and the rear panel, the recess situated between the top edge of the side panel and the rear edge of the rear panel. Thus, the method step of forming the building slab can include pouring the concrete slab around the pre-cast body so that the concrete flows into the recesses on each side panel.

It can be appreciated that the present invention contemplates a pre-cast dock pit that can be used to construct a dock having a load leveling mechanism at the building site. The pre-cast dock pit includes features that allow ready pouring of the dock slab on which the leveling mechanism will be supported. In addition, the pre-cast dock pit includes features that complement the pouring of the building slab around the pre-cast pit. These features allow the pre-cast pit to be smoothly integrated into the eventual building slab, with aspects that help solidly anchor the pre-cast pit in place.

One benefit of the present invention is that it greatly simplifies the process of forming a dock pit for supporting a dock leveling mechanism. A further benefit resides in features of the pre-cast pit that allow the pit to be accurately sized for s snug fit within the dock opening of the building.

Yet another benefit enjoyed by the present invention is that the construction of a dock pit can be performed much more quickly than with prior construction systems. The pre-cast pit allows pouring concrete around the dock pit without the need for forms or any additional preparation of the pit excavation that normally accompanies dock pit construction.

These and other benefits and advantages of the invention will be readily discerned from the following written description, taken together with the accompanying figures.

DESCRIPTION OF THE PREFERRED EMBODIMENT

Figure 1:
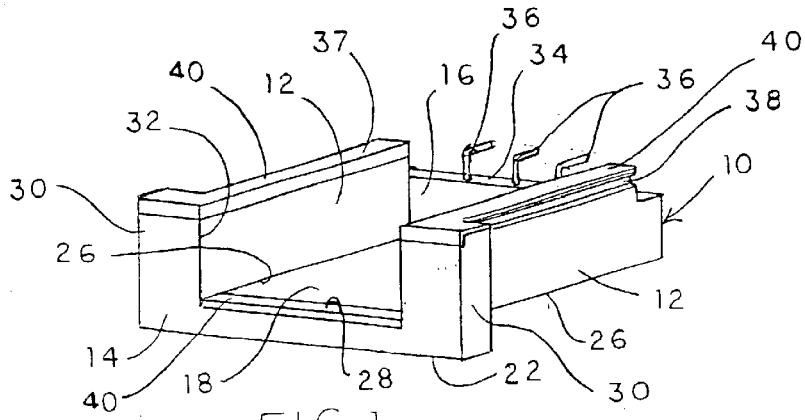
FIG. 1 is a perspective view of a pre-cast dock leveler pit in accordance with one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present invention contemplates a one-piece pre-cast dock leveler pit for placement during construction of a building. The pre-cast pit integrates into the poured slab and provides means for separately pouring the pit slab to support the dock leveler mechanism. According to one embodiment of the invention, a pre-cast dock leveler pit 10 includes opposite side panels 12, a front panel 14 and a rear panel 16, all integrally formed as a single casting. The front, rear and side panels define an open base 18, meaning that the pre-cast pit does not include an integrally cast base. This aspect provides significant benefits when the pre-cast pit is positioned within a pit excavation, as will be explained herein.

The pre-cast pit 10 is configured to be supported on footings at the building construction site. Thus, the front panel 14 includes a front footing edge 22 and the rear panel includes a rear footing edge 24 that are configured to rest on the footings. The edges 26 of the side walls need not rest on footings.

The front panel 14 includes a front ledge 28 flanked by a pair of front wings 30. The ledge and wings form a front access opening 32 that will eventually form part of the dock opening. The dock leveler mechanism will operate through the opening 32 when the pit and leveler mechanism have been installed.

The rear panel 16 includes a rear slab edge 34 that is recessed vertically relative to the top edges 37 of the side panels 12. As explained below, the rear slab edge forms a guide surface when the building slab is poured after the pre-cast pit has been installed. To that end, the pre-cast pit 10 includes a number of bent rebars 36 projecting from the rear slab edge 34. In the illustrated embodiment, three such rebars are uniformly spaced along the length of the rear panel 16, although different numbers of rebars may be utilized. The rebars 36 are bent at a 90° angle and are positioned so that the bars will project into the middle of the poured floor.

Figure 3:
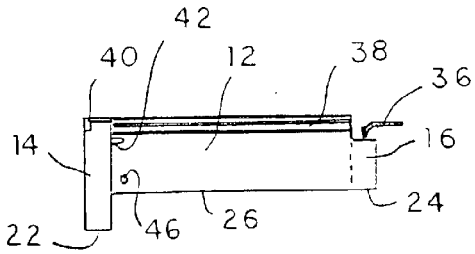
FIG. 3 is a side elevational view of the pre-cast dock leveler pit shown in FIG. 1.
Figure 4:
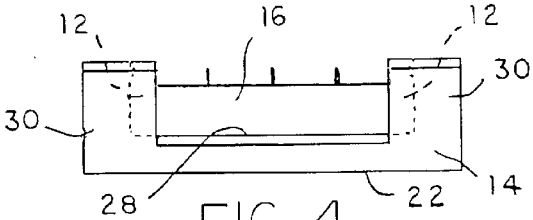
FIG. 4 is a front end elevational view of the pre-cast dock leveler pit shown in FIG. 1.
Figure 5:
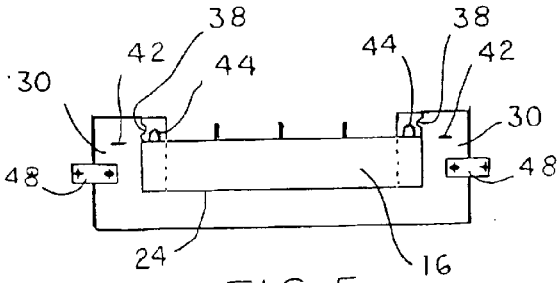
FIG. 5 is rear end elevational view of the pre-cast dock leveler pit shown in FIG. 1.

The rebars 36 help fix the pre-cast pit 10 relative to the poured slab of the building. In addition, each side panel 12 defines a recessed keyway 38 adjacent the top edge 37 of the panel and extending along substantially the entire length of the side panel, as best seen in FIGS. 1, 3 and 5. The recessed keyways 38 allows the poured slab concrete to flow therein to provide a smooth interface between the pre-cast pit 10 and the poured building floor and to firmly fix the position of the pit. The keyways 38 are recessed so that when the building floor is poured the surface of the floor is not disrupted or susceptible to pitting and cracking by a projecting keyway. In other words, if the keyways 38 projected outward from the side panels 12, the poured concrete would have a minimal thickness directly above the projecting keyway, which would significantly impair the strength and endurance of the poured concrete in that region. On the other hand, when the keyway is recessed, as with the present invention, the poured floor maintains a constant thickness throughout its entire extent, even at the joint between the floor and the pre-cast pit. The keyway can be sufficiently wide so that the concrete flowing into the keyways 38 is sufficiently thick to lock the pre-cast pit in position. It is not anticipated that the keyway joint will experience much shear loading since the pre-cast pit is resting on the building footings.

In order to improve the strength of the pre-cast pit, certain edge surfaces of the pit 10 can include an angle beam 40. Thus, as shown in FIG. 1, an angle beam can be provided at the top edge 37 of the side walls 12, as well as the top edge top edges of the front wings 30. In addition, an angle beam 40 can be provided at the front ledge 28 of the front panel 14. Preferably, the angle beams are cast into the pre-cast pit 10 when the pit is formed. Alternatively, the top edges of the side panels, front panel and front ledge can be configured to include a ledge for flush mounting of the angle beams 40.

Figure 2:
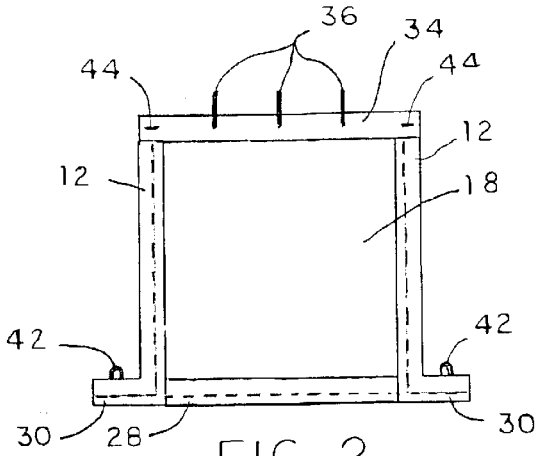
FIG. 2 is a top elevational view of the pre-cast dock leveler pit shown in FIG. 1.

Since the pre-cast pit 10 is fully formed before it is placed at the building site, some means must be provided to allow the pre-cast pit to be carried and lowered into position. Consequently, the pre-cast pit includes fort lifting rings 42 projecting inward from the front panel 14, and rear lifting rings 44 projecting upward from the rear slab edge 34, as shown best in FIGS. 2 and 5. Since the lifting rings will be covered by the poured building slab, the location and size of the rings can be readily altered. It is preferable, however, that the location of the lifting rings 42, 44 allow for balanced lifting and lowering of the pre-cast pit.

One optional feature of the pre-cast pit 10 of the present invention is a pre-cast electrical access opening 46 through one or both side panels 12, as shown in FIG. 3. This opening allows the electrical power and control circuitry to be fed into the interior of the dock leveler pit at an appropriate time during the construction of the building.

In another aspect, the pre-cast pit can include a number of anchor plates 48 extending laterally outwardly from the inside surface of the front wings 30, as shown in FIG. 5. The anchor plates are preferably added to the pit after it has been cast. The anchor plates 48 can be of known construction in the concrete building art. The anchor plates can help stabilize the pre-cast pit after it has been dropped into place within the dock construction, but before the remaining concrete has been poured.

Figure 6:
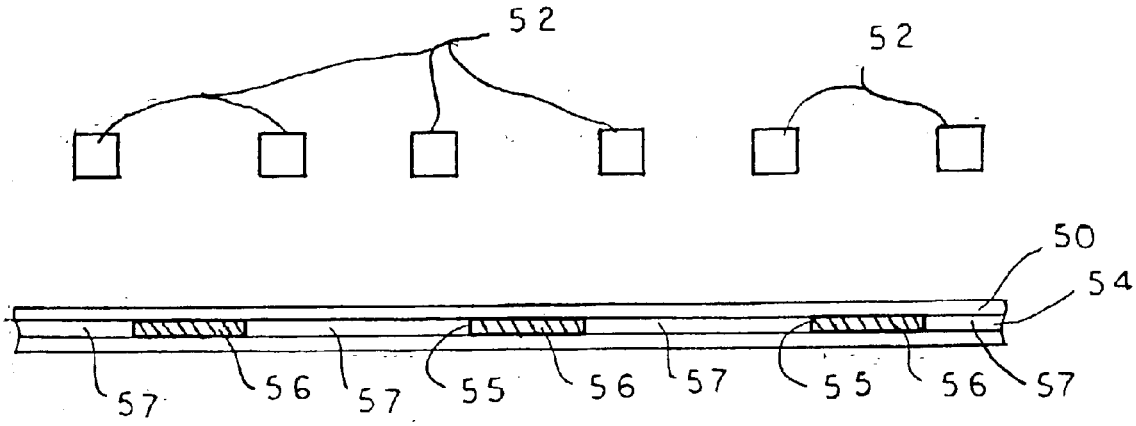
FIG. 6 is a top plan view a first step in the construction of a multiple loading dock in which footing are laid and building walls are erected.
Figure 7:
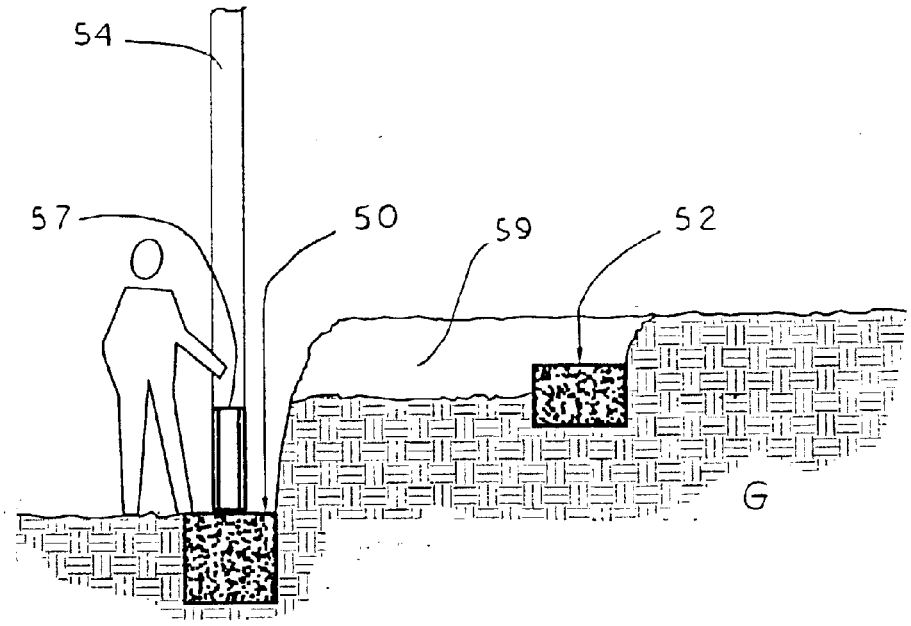
FIG. 7 is a side view of the building construction step shown in FIG. 6 at one dock location.
Figure 10:
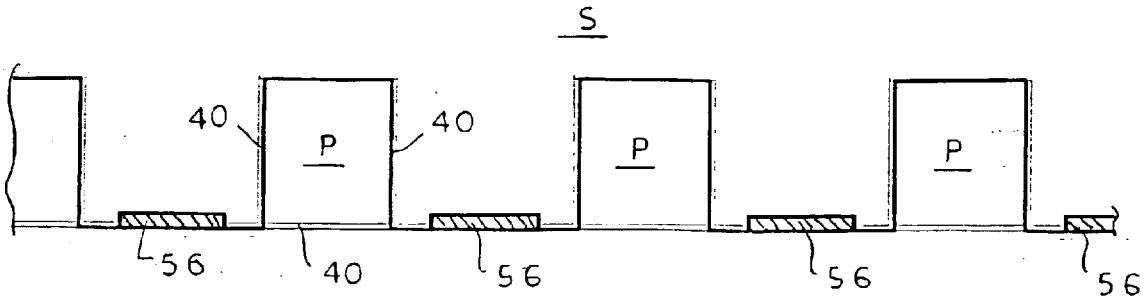
FIG. 10 is a top plan view a subsequent step in the construction of a multiple loading dock in which the floor is poured around the pre-cast dock leveler pit to form the finished loading dock.
Figure 11:
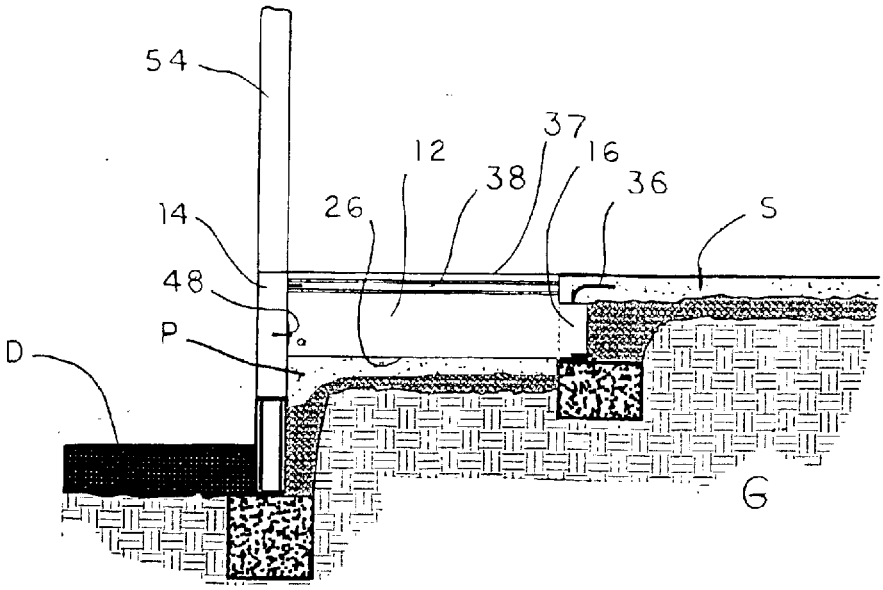
FIG. 11 is a side view of the building construction step shown in FIG. 10.
Figure 12:
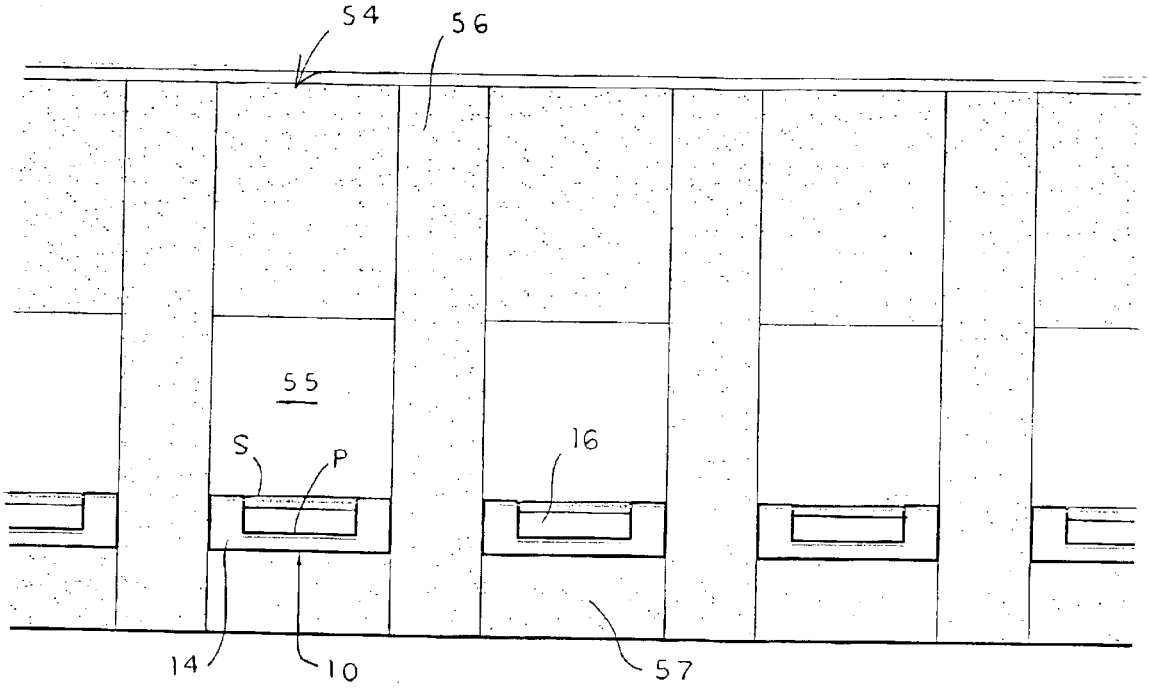
FIG. 12 is a front view of the completed building with multiple loading docks utilizing the pre-cast dock leveler pit of the present invention.

The construction process for installation of the pre-cast pit 10 of the present invention is depicted in FIGS. 6–12. Prior to installation of the pre-cast pit 10, the building site is prepared. In accordance with known building construction, a building footing 50 is poured around the perimeter of the building. The footing 50 is configured to support the weight the building walls 54. In a preferred construction, the building walls 54 are formed of a number of pre-cast panels, as best seen in FIG. 12. The building walls include a number of support walls 55, separated by loading dock ledge walls 57, as shown in FIG. 6. In accordance with the present invention, the ledge walls 57 have a height lower then the anticipated loading dock height. Preferably, the ledge walls 57 have a height that approximates the depth of the pit excavation 59 dug into the ground G to receive the pre-cast dock leveler pit 10 of the present invention.

In addition to the building footing 50, footing pads 52 are provided at the innermost portion of the pit excavation 59. As shown in the top plan view of FIG. 6, the footing pads 52 are generally situated near the lateral extent of the dock ledge walls 57. More particularly, the footing pads are positioned to support the rear panel 16 of each pre-cast pit 10 when the corresponding front panel 14 is supported on the dock ledge wall 57.

Figure 8:
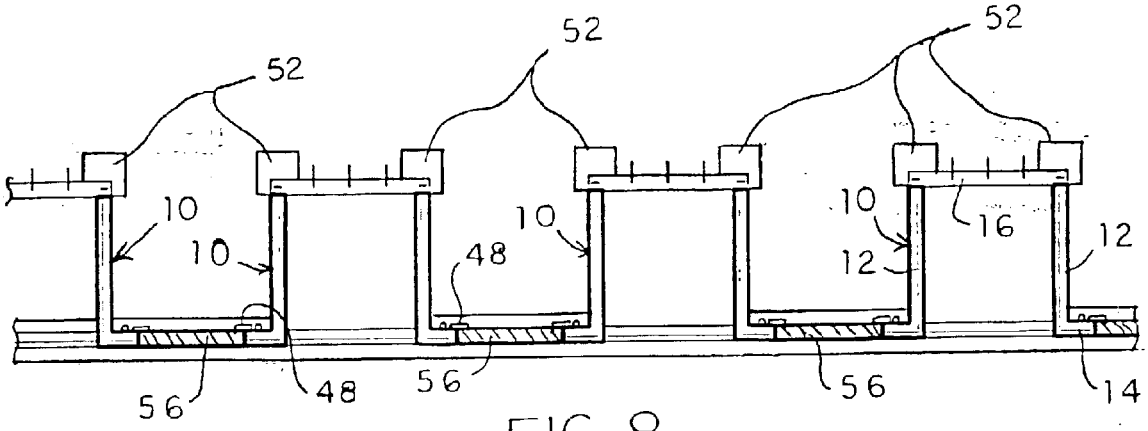
FIG. 8 is a top plan view a subsequent step in the construction of a multiple loading dock in which the pre-cast dock leveler pit shown in FIGS. 1–5 is lifted into position relative to the footings.
Figure 9:
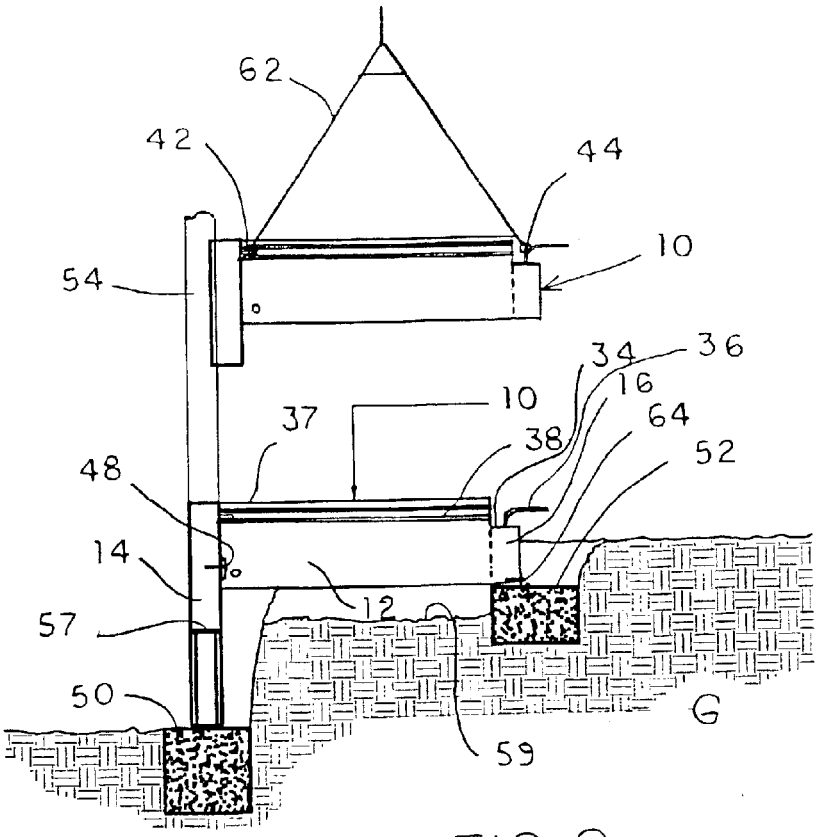
FIG. 9 is a side view of the building construction step shown in FIG. 8.

As shown in FIG. 9, each pre-cast pit 10 can be lifted by a lifting rig 62 engaged to the front and rear lifting rings 42, 44. The lifting rig and rings can be of conventional construction to support the pre-cast concrete pit 10. As can be seen from FIG. 9, the positioning of the lifting rings 42, 44 allow the pre-cast pit to be carried in a balanced position so that the pit can be easily and accurately lowered into the pit excavation 59. More importantly, the pre-cast pit 10 can be lowered into its final positioned supported on the ledge wall 57 and rear footing pads 52, as shown in FIGS. 8 and 9. As shown in FIG. 9, the rear slab edge 34 is situated slightly above the leveled ground surface G, and the bent rebars 36 are oriented at a position that will put them firmly into the middle of the poured concrete slab.

Once the pre-cast pit 10 has been dropped into position, the anchor plates 48 can be fastened to the adjacent support wall 56 by driving concrete nails through the plates and into the wall. It may be necessary to level the pre-cast pit, so a shim and anchor arrangement 64 can be introduced at the rear footing pads 52. The shim and anchor arrangement can be of any known configuration that is adequate to ensure that the top edges 37 of the side panels 12 are level.

It should be appreciated from the top view of FIG. 8 that the front panel 14 and particularly the front wings 30 span the width of the loading dock so that the lateral edges of the wings directly abut the adjacent support walls 56. Subsequent caulking of the joint between the pre-cast pit and the support wall will form a solid, weather tight seal.

Referring now to FIGS. 10, 11, the final installation steps are depicted. In particular, fill can be added to the ground surface G and to the pit excavation 59. The fill should be added to a typical depth, with the understanding the subsequent concrete pour must integrate with the pre-cast pit, as shown in FIG. 11, to form smooth and accurate joints. Thus, the slab S forming the building floor is poured so that the rebars 36 are embedded within the slab, and so that the slab surface is co-extensive with the top edge 37 of the pit.

In addition, a dock leveling pit slab P is formed beneath the side edges 26 of the side panels 12. As pointed out above, the pre-cast pit 10 does not include a bottom wall. Thus, the final pouring step includes preparing the pit excavation 59 and pouring the concrete so that the concrete forms a level slab slightly inside the side panels 12. With this approach, the perimeter of the pre-cast pit 10 acts as a form for the poured concrete, so no separate form is required.

As shown in FIG. 10, the building slab S is poured around each of the pre-cast pits so that the pre-cast pits are essentially uniformly integrated into the final slab. Of course, if the pre-cast pits include the angle beams 40, the beams will be exposed at the level of the slab S. In addition, as shown in FIG. 10, the dock leveling pit slab P is also uniformly integrated into the pre-cast pits. Thus, the concrete poured into the interior of the building fully and completely integrates each pre-cast dock leveling pit to provide a uniform and sturdy construction. Preferably, the pit slab P is poured first, followed by the building slab S. In this way, fill can be added at the sides of the pre-cast pit for the building slab poured around the upper perimeter of the pit 10.

When viewed from the front, as shown in FIG. 12, the entire construction also presents a uniform appearance. The rear panel 16 is exposed at the back of the pit and uniformly blends into the building slab S. The front panel 14 is exposed and uniformly blends into the support walls 56. The joint between the front panel 14 and the support walls 56, as well as between the front panel and the loading dock ledge wall 57, can be sealed by caulking to form a clean, weatherproof perimeter.

The dimensions of the pre-cast pit can be determined by the dimensions of the particular loading dock, and of the selected dock leveler mechanism. The wall thickness of the panels forming the integral pre-cast pit are preferably about eight inches (8"), which corresponds to the typical slab depth for a poured concrete slab. The keyways can be recessed at a depth of about two inches (2").

As shown in FIG. 3, the front panel 14 overhangs below the lower side edge 26 of the side panels 12 and rear panel 16. In a preferred embodiment, this overhang is about twelve inches (12"). This overhang is preferable to provide sufficient room beneath the lower side edges 26 for the fill and poured concrete within the pit excavation. The height of the side panels is dictated by the depth of pit necessary to accommodate the dock leveler mechanism. In a typical case, that height is about two feet (2').

The pre-cast pit 10 can be formed according to conventional concrete casting techniques. In one approach, a two-piece forming mold can be provided that has an interior surface that conforms to the outer surface configuration of the final pre-cast pit. The mold can include means for supporting the non-concrete elements, such as the lifting rings 42, 44 and the rebars 34, at their appropriate positions. The mold can define a pour opening for introduction of the concrete mixture, which opening can be a single opening at one end of the mold or can be in the form of an open upper perimeter of the mold. Preferably, the concrete is wet to a 5–6 slump for pouring, and the mold is vibrated to ensure a full fill of the mold. The mold forms can take on a variety of configurations and complexities known in the art, as reflected in several patents, including U.S. Pat. Nos. 3,063,122; 5,728,312 and 5,755,982.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A dock pit for a dock leveler mechanism, comprising:

a pre-cast body including side panels, a rear panel and a front panel, the panels forming a perimeter sized to receive the load leveler mechanism therein, said front panel including a front footing edge and said side panels including side edges, said front panel configured to overhang said side panels with said front footing edge offset below said side edges.

2. The dock pit according to claim 1, wherein each of said side panels includes a recess defined therein along the length of the side panel between the front panel and the rear panel, the recess situated between a top edge of the side panel and a rear edge of said rear panel, whereby a slab poured around the pre-cast body will integrate within the recesses on each said side panel.

3. The dock pit according to claim 1, wherein said rear panel includes a number of rebars extending from a rear edge thereof and arranged to be embedded within the building slab when the slab is abutting said rear edge.

4. The dock pit according to claim 1, further comprising a poured slab within said perimeter defined by said panels.

5. The dock pit according to claim 1, further comprising lifting rings embedded within the pre-cast body.

6. The dock pit according to claim 5, wherein said lifting rings include at least two lifting rings at a front portion of said pre-cast body and at least two lifting rings at a rear portion of said body.

7. The dock pit according to claim 1, further comprising an angle beam embedded within said pre-cast body along a number of upper edges thereof.

8. The dock pit according to claim 3, wherein said number of rebars are substantially L-shaped.

9. The dock pit according to claim 1, wherein each of said side panels has a top edge and the rear panel has a rearmost edge offset below said top edge of said side panels, whereby a building slab poured around the pre-cast body will abut said rearmost edge of said rear panel with the surface of the building slab substantially flush with said top edge of each side panel.

10. A dock pit for a dock leveler mechanism, comprising:

a pre-cast body including side panels, a rear panel and a front panel, the panels forming a perimeter sized to receive the load leveler mechanism therein, said front panel including a pair of opposite wings and a ledge disposed between and separating said wings, said ledge having a height less than the height of said wings so that said wings and said ledge define a from opening for providing access to a dock reveler mechanism mounted within the dock pit.

11. The dock pit according to claim 10, wherein each of said side panels includes a recess defined therein along the length of the side panel between the front panel and the rear panel, the recess situated between a top edge of the side panel and a rear edge of said rear panel, whereby a slab poured around the pre-cast body will integrate within the recesses on each said side panel.

12. The dock pit according to claim 10, wherein said rear panel includes a number of rebars extending from a rear edge thereof and arranged to be embedded within the building slab when the slab is abutting said rear edge.

13. The dock pit according to claim 12, wherein said number of rebars are substantially L-shaped.

14. The dock pit according to claim 10, further comprising a poured slab within said perimeter defined by said panels.

15. The dock pit according to claim 10, further comprising lifting rings embedded within the pre-cast body.

16. The dock pit according to claim 15, wherein said lifting rings include at least two lifting rings at a front portion of said pre-cast body and at least two lifting rings at a rear portion of said body.

17. The dock pit according to claim 10, further comprising an angle beam embedded within said pre-cast body along a number of upper edges thereof.

18. The dock pit according to claim 10, wherein each of said side panels has a top edge and the rear panel has a rearmost edge offset below said top edge of said side panels, whereby a building slab poured around the pre-cast body will abut said rearmost edge of said rear panel with the surface of the building slab substantially flush with said top edge of each side panel.

* * * * *

UNITED STATES PATENT AND TRADEMARK OFFICE

CERTIFICATE OF CORRECTION

PATENT NO. : 6,922,955 B2
DATED : August 2, 2005
INVENTOR(S) : Mark Sanders

It is certified that error appears in the above-identified patent and that said Letters Patent is hereby corrected as shown below:

Column 8,
Line 32, replace “from” with -- front --.
Line 33, replace “reveler” with -- leveler --.

Signed and Sealed this

Ninth Day of May, 2006

JON W. DUDAS
*Director of the United States Patent and Trademark Office*